US008225827B2

(12) United States Patent
Dunlap et al.

(10) Patent No.: US 8,225,827 B2
(45) Date of Patent: Jul. 24, 2012

(54) SHARPENER WITH NOISE REDUCING FEATURES

(75) Inventors: Ben Dunlap, Statesville, NC (US); Michael Schumacher, Hilliard, OH (US)

(73) Assignee: Elmer's Products, Inc., Westerville, OH (US)

( * ) Notice: Subject to any disclaimer, the term of this patent is extended or adjusted under 35 U.S.C. 154(b) by 275 days.

(21) Appl. No.: 12/827,184

(22) Filed: Jun. 30, 2010

(65) Prior Publication Data

US 2010/0326569 A1 Dec. 30, 2010

Related U.S. Application Data

(60) Provisional application No. 61/269,853, filed on Jun. 30, 2009.

(51) Int. Cl.
*B43L 23/00* (2006.01)
*B43L 23/02* (2006.01)

(52) U.S. Cl. ..... 144/28.6; 144/28.72; 144/28.8

(58) Field of Classification Search ..... 241/28.3–28.7, 241/28.71, 28.72, 28.8, 28.9
See application file for complete search history.

(56) References Cited

U.S. PATENT DOCUMENTS

| | | | | | |
|---|---|---|---|---|---|
| 3,125,994 | A * | 3/1964 | Ruskin | ..... | 144/28.72 |
| 3,134,365 | A * | 5/1964 | Hori | ..... | 144/28.5 |
| 3,556,182 | A * | 1/1971 | Tanigami | ..... | 144/28.5 |
| 3,650,308 | A * | 3/1972 | Hori | ..... | 144/28.5 |
| 3,678,975 | A * | 7/1972 | Imanishi et al. | ..... | 144/28.5 |
| 3,777,791 | A * | 12/1973 | Uchida | ..... | 144/28.72 |
| 3,965,949 | A * | 6/1976 | Aston et al. | ..... | 144/28.71 |
| 4,966,208 | A * | 10/1990 | Uang | ..... | 144/28.72 |
| 6,470,929 | B2 * | 10/2002 | Fregeolle | ..... | 144/28.72 |
| 6,886,614 | B2 * | 5/2005 | Ricono et al. | ..... | 144/28.11 |

* cited by examiner

*Primary Examiner* — Bena Miller
(74) *Attorney, Agent, or Firm* — McNees Wallace & Nurick, LLC

(57) ABSTRACT

An electric pencil sharpener is provided. This pencil sharpener includes a motor, a cutter assembly, mechanical means for operatively connecting the motor to the cutter assembly, and a housing. The cutter assembly includes a rotating carrier with at least two helical cutters mounted on the carrier. The mechanical means for operatively connecting the motor to the cutter assembly further includes a first gear assembly mechanically coupled to the motor; a second gear assembly mechanically coupled to the first gear assembly and to the cutter assembly; a gearbox for supporting the first and second gear assemblies; and a cover for enclosing the first gear assembly. The housing further includes a canopy and a base positioned underneath the canopy.

20 Claims, 6 Drawing Sheets

SHARPENER WITH NOISE REDUCING FEATURES

CROSS-REFERENCE TO RELATED APPLICATIONS

This patent application claims the benefit of U.S. Provisional Patent Application Ser. No. 61/269,853 filed on Jun. 30, 2009 and entitled "Sharpener with Noise Reducing Features", U.S. Provisional Patent Application Ser. No. 61/221,221 filed on Jun. 29, 2009 and entitled "Sharpener with Autostop Feature", and U.S. Non-Provisional patent application Ser. No. 12/826,041 filed on Jun. 29, 2010 and entitled "Pencil Sharpener with Autostop Feature", the disclosures of which are hereby incorporated by reference herein in their entirety and made part of the present U.S. utility patent application for all purposes.

BACKGROUND OF THE INVENTION

The described invention relates in general to an electric pencil sharpener and more specifically to an electric pencil sharpener that includes a variety of features for reducing the noise typically generated by such devices.

Electric pencil sharpeners are very common devices in modern offices, schools, and places of business. To use an electric pencil sharpener, the user typically inserts a pencil in need of sharpening into and through an opening at one end of the sharpener. Once inserted, the pencil activates a motor which drives one or more rotating sharpening blades that remove the wood casing from around the piece of lead embedded within the body of the pencil. While generally quite effective at sharpening pencils, electric pencil sharpeners often tend to generate a significant amount of noise during operation. This noise can be very disruptive and may even result in such pencil sharpeners being banned from particular environments. Therefore, there is an ongoing need for a reliable electric pencil sharpener that quietly and effectively sharpens pencils or similar items.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, an electric pencil sharpener having noise reducing features is provided. This pencil sharpener includes a motor, a cutter assembly, mechanical means for operatively connecting the motor to the cutter assembly, and a housing for containing the motor, the cutter assembly, and the mechanical means for operatively connecting the motor to the cutter assembly. The cutter assembly further includes a rotating carrier, wherein the carrier further includes a carrier shaft; at least two helical cutters mounted on the carrier, wherein the helical cutters define a conical cavity therebetween; and a barrel positioned at the large end of the conical cavity, wherein the barrel includes a bore formed therein for receiving a pencil. The mechanical means for operatively connecting the motor to the cutter assembly further includes a first gear assembly mechanically coupled to the motor; a second gear assembly mechanically coupled to the first gear assembly and to the cutter assembly; a gearbox for supporting the first and second gear assemblies; and a cover for enclosing the first gear assembly. The housing further includes a canopy, wherein the canopy further includes an aperture in the front portion thereof, and wherein the aperture is adapted to receive a pencil; and a base positioned underneath the canopy, wherein the base further includes at least one mount formed thereon, and wherein the at least one mount is adapted to receive the bottom portion of the gearbox.

In accordance with another aspect of the present invention, an electric pencil sharpener having additional noise reducing features is provided. This pencil sharpener includes a motor, a cutter assembly, mechanical means for operatively connecting the motor to the cutter assembly, a housing for containing the motor, the cutter assembly, and the mechanical means for operatively connecting the motor to the cutter assembly, and at least one vibration dampening device. The motor is a DC motor having a voltage of about 120V. The cutter assembly further includes a rotating carrier, wherein the carrier further includes a carrier shaft; at least two helical cutters mounted on the carrier, wherein the helical cutters define a conical cavity therebetween; and a barrel positioned at the large end of the conical cavity, wherein the barrel includes a bore formed therein for receiving a pencil. The mechanical means for operatively connecting the motor to the cutter assembly further includes a first gear assembly mechanically coupled to the motor; a second gear assembly mechanically coupled to the first gear assembly and to the cutter assembly; a gearbox for supporting the first and second gear assemblies; and a cover for enclosing the first gear assembly. The housing further includes a canopy, wherein the canopy further includes an aperture in the front portion thereof, and wherein the aperture is adapted to receive a pencil; and a base positioned underneath the canopy, wherein the base further includes at least one mount formed thereon, and wherein the at least one mount is adapted to receive the bottom portion of the gearbox. The at least one vibration dampening device is positioned between the bottom of the gearbox and the top of the at least one mount formed on the base portion of the housing.

In yet another aspect of this invention, an electric pencil sharpener having still more noise reducing features is provided. This pencil sharpener includes a motor, a cutter assembly, mechanical means for operatively connecting the motor to the cutter assembly, a housing for containing the motor, the cutter assembly, and the mechanical means for operatively connecting the motor to the cutter assembly, at least one vibration dampening device, and a plurality of feet attached to the base for supporting the pencil sharpener above a surface upon which it has been placed. The motor is a DC motor having a voltage of at least 120V. The cutter assembly further includes a rotating carrier, wherein the carrier further includes a carrier shaft; at least two helical cutters mounted on the carrier, wherein the helical cutters define a conical cavity therebetween; and a barrel positioned at the large end of the conical cavity, wherein the barrel includes a bore formed therein for receiving a pencil. The mechanical means for operatively connecting the motor to the cutter assembly further includes a first gear assembly mechanically coupled to the motor; a second gear assembly mechanically coupled to the first gear assembly and to the cutter assembly; a metal gearbox for supporting the first and second gear assemblies; and a cover for enclosing the first gear assembly. The housing further includes a canopy, wherein the canopy further includes an aperture in the front portion thereof, and wherein the aperture is adapted to receive a pencil; and a base positioned underneath the canopy, wherein the base further includes at least one mount formed thereon, and wherein the at least one mount is adapted to receive the bottom portion of the gearbox. The at least one vibration dampening device is positioned between the bottom of the gearbox and the top of the at least one mount formed on the base portion of the housing. The feet are suction cup-shaped elastomeric devices that are inserted into the base.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
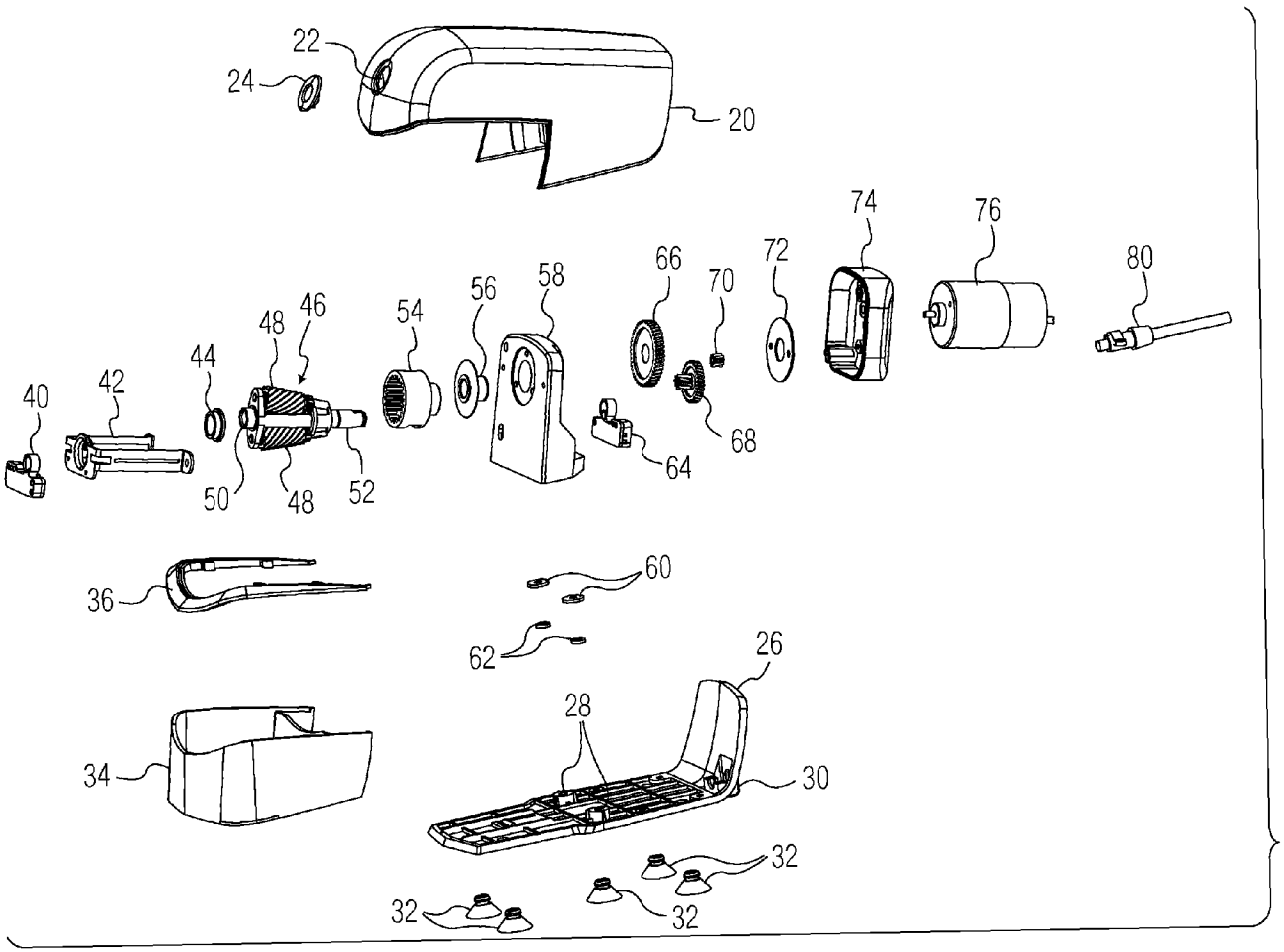
FIG. 1 is an exploded, perspective view of an electric pencil sharpener in accordance with an exemplary embodiment of the present invention.

Exemplary embodiments of the present invention are now described with reference to the Figures. Reference numerals are used throughout the detailed description to refer to the various elements and structures. In other instances, well-known structures and devices may be shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

Figure 2:
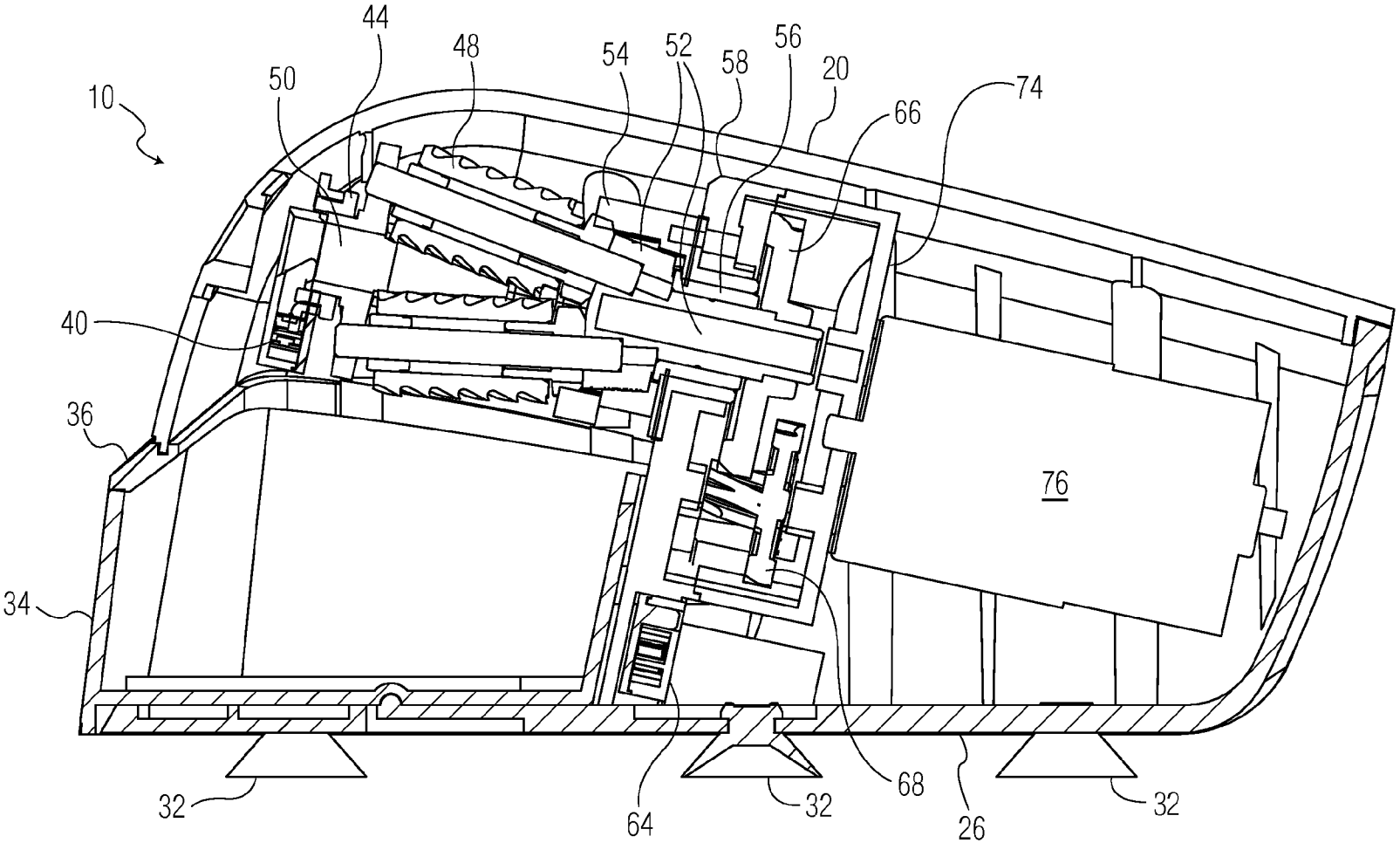
FIG. 2 is a right side section view of the pencil sharpener of FIG. 1 at the middle of the sharpener.
Figure 3:
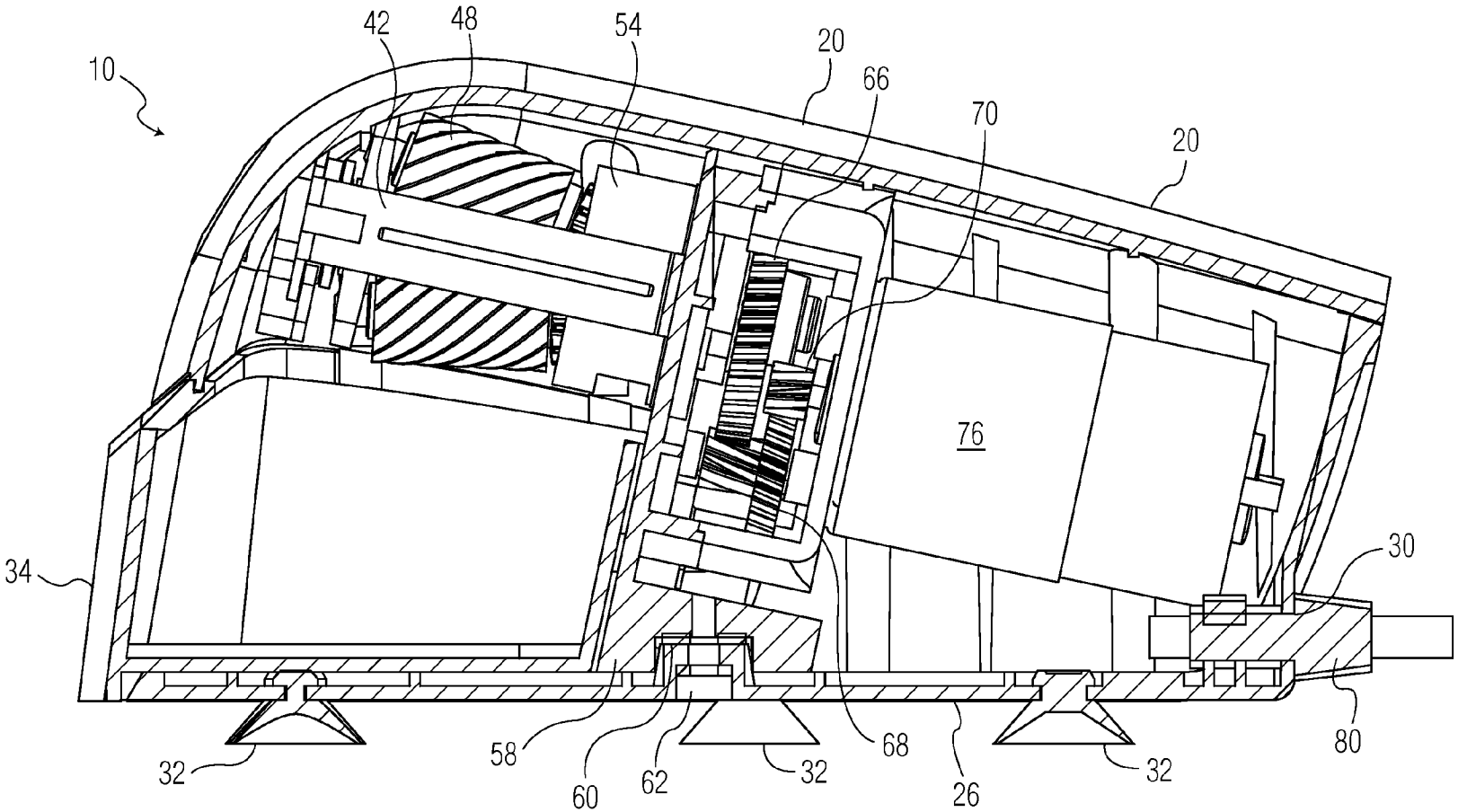
FIG. 3 is a right side section view of the pencil sharpener of FIG. 1 at the middle of the right gearbox mount.
Figure 4:
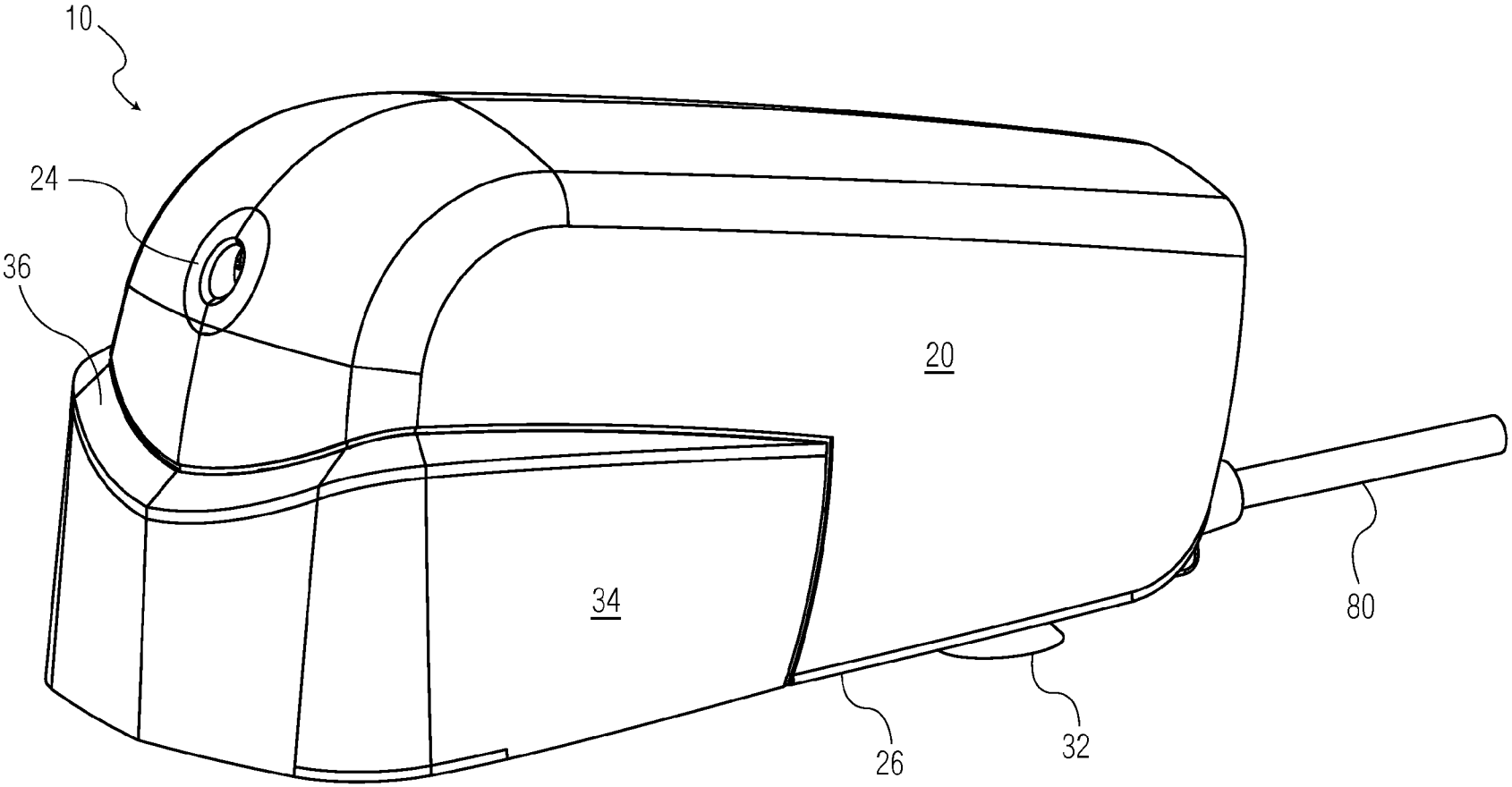
FIG. 4 is a perspective view of the exterior of the pencil sharpener of FIG. 1.
Figure 5:
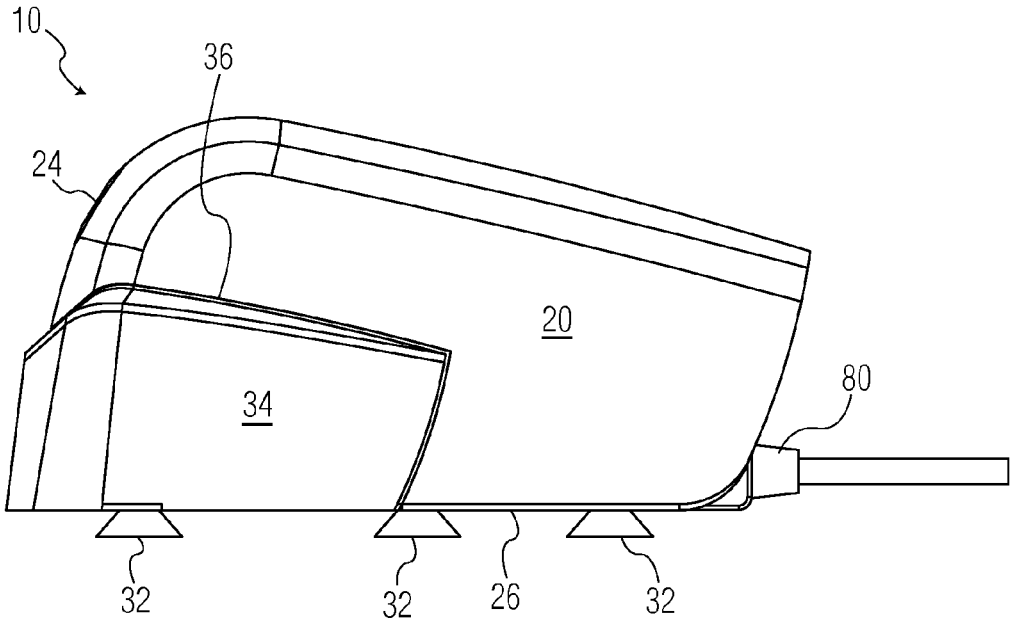
FIG. 5 is a side view of the exterior of the pencil sharpener of FIG. 1.
Figure 6:
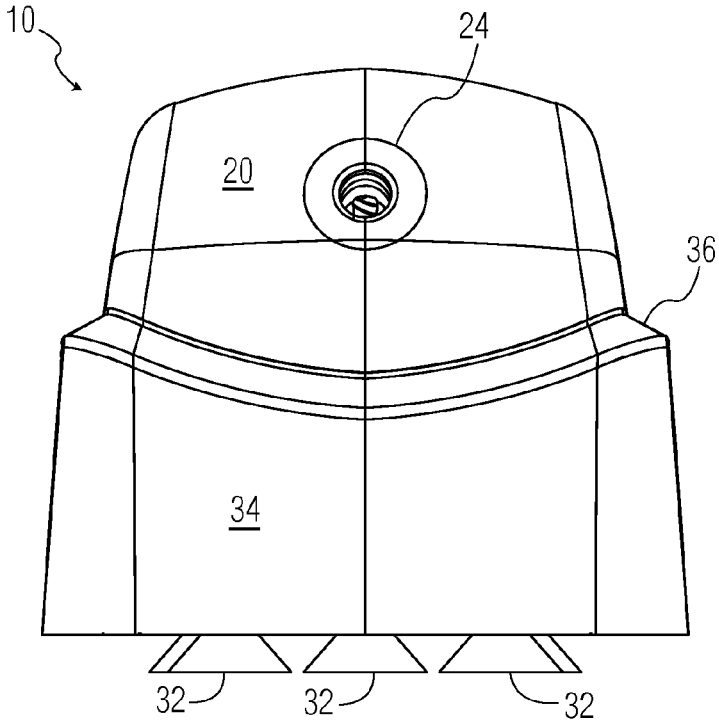
FIG. 6 is a front view of the exterior of the pencil sharpener of FIG. 1.
Figure 7:
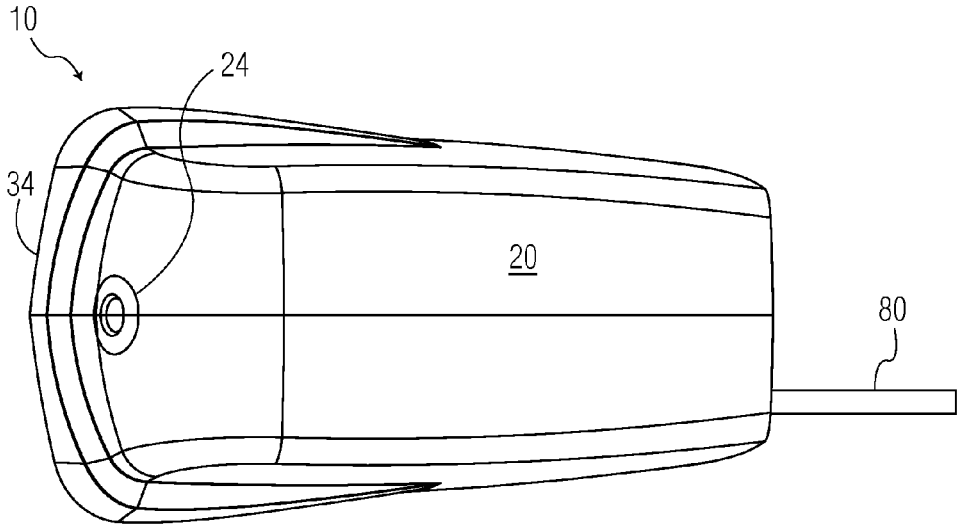
FIG. 7 is a top view of the exterior of the pencil sharpener of FIG. 1.
Figure 8:
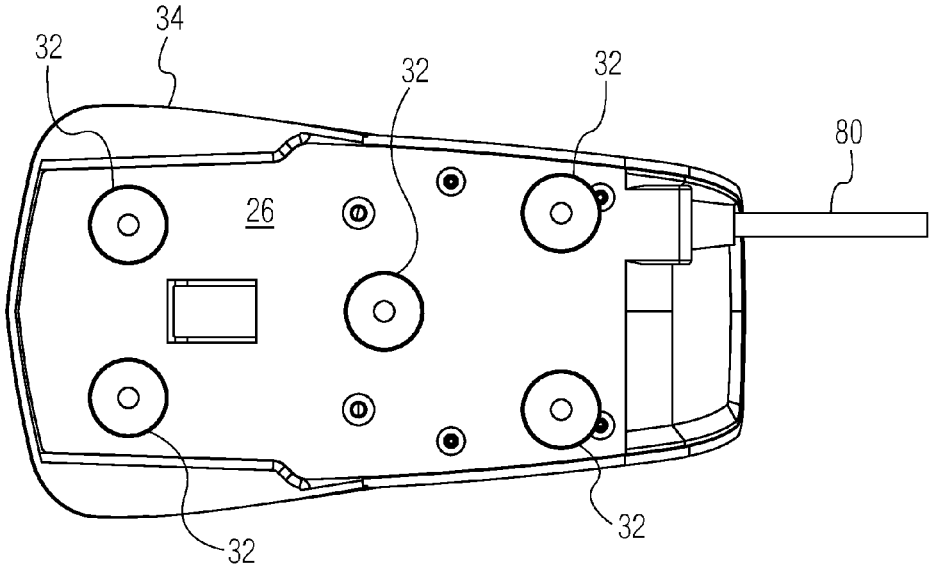
FIG. 8 is a bottom view of the exterior of the pencil sharpener of FIG. 1.

The present invention relates to a quiet electric sharpener for pencils and the like. With reference now to the Figures, one or more specific embodiments of this invention shall be described in greater detail. FIGS. 1-8 provide various views illustrative views of an exemplary embodiment of a quiet pencil sharpener in accordance with the present invention. As best shown in FIGS. 1-3, pencil sharpener 10 includes a multi-sectional housing that further includes top enclosure 20 having an aperture formed in the front portion thereof for receiving a pencil. A circular trim piece 24 is inserted into aperture 22. Base 26 supports top enclosure 20 and further includes mounts 28, which are adapted to receive the bottom portion of gearbox 58, as well as port 30, which is adapted to receive power cord 80. A plurality of elastomeric supports or "feet" 32 are inserted into the bottom of base 26 and serve both to support pencil sharpener 10 above a surface on which it is sitting and to isolate pencil sharpener 10 from such a surface for the purpose of reducing any vibrations created during operation of the sharpener. Shavings receptacle 34 is positioned on the front portion of base 26 and may be removed to discard any shavings generated by the sharpening process. In the embodiment shown in the Figures, a piece of trim 36 is attached to the top edge of shavings receptacle 34.

As best shown in FIGS. 1-3 the sharpening and drive train portions of pencil sharpener 10 include actuation switch 40, which activates motor 76 when a pencil is inserted into sharpener 10. Bracket 42, which is attached to gearbox 58, and ring 44, which is seated within bracket 42, support cutter assembly 46. Cutter assembly 46 includes barrel 50, which further includes a bore formed therein, two helical cutters 48, and cutter carrier 52, which further includes a shaft formed on one end thereof. Helical cutters 48 are mounted opposite one another on cutter carrier 52, each at an angle so to form a conical cavity therebetween for receiving the tip of a pencil in need of sharpening. The drive train of pencil sharpener 10 includes a first gear assembly, which is mechanically coupled to motor 76, and a second gear assembly, which is mechanically coupled to the first gear assembly. Both gear assemblies are supported by gearbox 58. In the exemplary embodiment shown in the Figures, the first gear assembly includes pinion gear 70, carrier gear 66, and third gear 68 operatively positioned between pinion gear 70 and carrier gear 66. The second gear assembly includes cutter drive gear 54, which is operatively connected to cutter assembly 46 and carrier bushing 56. As shown in FIG. 3, top and bottom gearbox isolation rings, 60 and 62 respectively, are positioned between gearbox 58 and mounts 28 (which are formed on base 26) for the purpose of minimizing any vibrations created by pencil sharpener 10 when in use. Receptacle interlock switch 64 in is included in the exemplary embodiment. This switch defeats motor 76 when receptacle 34 is removed from base 26. Motor insulation plate 72 is positioned within gearbox cover 74, which attaches to gearbox 58 and encloses the first gear assembly.

Advantageously, pencil sharpener 10 reduces the noise generated by the typical electric pencil sharpener by as much as 40%. The noise reducing aspects of this invention are provided by the inclusion of specific components within the device. In an exemplary embodiment, motor 76 is a high-voltage DC motor of about 120V, although other high voltage motors may be used with the present invention. Helical cutters 48 are left-handed cutters that rotate counterclockwise (from the front of the sharpener). This configuration tends to draw a pencil into the sharpener rather than pushing it out with each cut. Additionally, using right-handed helical cutters and reversing the direction of rotation also results in a pencil being drawn into the cutter and this configuration is used in alternate embodiments of this invention. Dual helical cutters 48 are mounted opposite one another on metal carrier 52 (versus the use of one cutter and a dead counterweight) for more precisely balancing carrier 52 and the cutting forces generated by helical cutters 48. Machining the shaft portion of carrier 52 and using precision bushing 56 for isolating vibration provides more discrete control of the rotation of carrier 52. The use of helical gearing between motor 76 and carrier 52 creates less noise than straight-cut spur gears and the use of a metal gearbox (58) with a cover (74) reduces the transmission of gear noise from within the device. Positioning elastomeric pads or o-rings 60 and 62 between the bottom of gearbox 58 and base 26, further isolates gearbox and motor vibrations from the exterior housing of pencil sharpener 10. Attaching elastomeric, suction cup-shaped feet to the bottom of base 26 also isolates vibrations generated within the enclosure from a surface upon which pencil sharpener 10 has been placed.

With regard to other specifications, in an exemplary embodiment of this invention motor 76 is a 120 volt DC motor operating at 2500-6500 RPM, no-load speed. AC/DC conversion is accomplished by a full-wave rectifier, although a half-wave rectifier may be used to further reduce motor speed and power. With regard to the gearbox and drive train, helical gear 54 has an 8° helix angle, pinion gear 70 is an 8T pinion gear, carrier gear 66 is a 45T gear, and gear 68 is a 32T/8T double gear. The final drive ratio at carrier 52 is 1:22.5 and the carrier drive speed is about 110-290 RPM (no load). The gears are typically die-cast aluminum, although other materials may be used. Helical cutters 48 are 12-flute cutters with a case hardened to HRC 60-65 (at least 0.020" deep). There is a slight undercut in the tooth profile (i.e., a slight rake angle, approximately 5° or higher) and the cutter diameters have a concentricity of 0.0015" or better. Carrier 52 is typically die-cast zinc. Feet 32 and isolation pads 60 and 62 are thermoplastic polyurethane (TPU) or a similar elastomer. Enclosure 20 is Chi Mei ABS, Type 757 and in some embodiments a damping coating, such as latex QuietCoat, is applied to the inside of the enclosure to further dampen vibrations. Other embodiments of this invention include an auto-stop feature, such as that disclosed in U.S. patent application Ser. No. 12/826,041, which is incorporated by reference herein in its entirety, for all purposes.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. An electric pencil sharpener, comprising:

(a) a motor;

(b) a cutter assembly, wherein the cutter assembly further includes:

(i) a rotating carrier, wherein the carrier further includes a carrier shaft;

(ii) at least two helical cutters mounted on the carrier, wherein the helical cutters define a conical cavity therebetween; and (iii) a barrel positioned at the large end of the conical cavity, wherein the barrel includes a bore formed therein for receiving a pencil; and (c) mechanical means for operatively connecting the motor to the cutter assembly, wherein the mechanical means for operatively connecting the motor to the cutter assembly further includes:

(i) a first gear assembly mechanically coupled to the motor;

(ii) a second gear assembly mechanically coupled to the first gear assembly and to the cutter assembly;

(iii) a gearbox for supporting the first and second gear assemblies; and (iv) a cover for enclosing the first gear assembly; and (d) a housing for containing the motor, cutter assembly, and the mechanical means for operatively connecting the motor to the cutter assembly, wherein the housing further includes:

(i) a canopy, wherein the canopy further includes an aperture in the front portion thereof, and wherein the aperture is adapted to receive a pencil; and (ii) a base positioned underneath the canopy, wherein the base further includes at least one mount formed thereon, and wherein the at least one mount is adapted to receive the bottom portion of the gearbox.

2. The pencil sharpener of claim 1, further comprising at least one vibration dampening device positioned between the bottom of the gearbox and the top of the at least one mount formed on the base portion of the housing.

3. The pencil sharpener of claim 1, further comprising a plurality of elastomeric feet attached to the base for supporting the pencil sharpener above a surface upon which it has been placed.

4. The pencil sharpener of claim 1, wherein the motor is a high-voltage DC motor of about 120 V.

5. The pencil sharpener of claim 1, wherein the carrier shaft has been machined to provide more precise control of the rotation of the carrier.

6. The pencil sharpener of claim 1, wherein the helical cutters are left-handed cutters that are rotated counter-clockwise.

7. The pencil sharpener of claim 1, wherein the helical cutters are right-handed cutters that are rotated clockwise.

8. The pencil sharpener of claim 1, wherein the first gear assembly further includes a pinion gear, a carrier gear, and a third gear positioned between the pinion gear and the carrier gear.

9. The pencil sharpener of claim 1, wherein the second gear assembly further includes a helical drive gear and a bushing positioned between the helical drive gear and the carrier gear of the first gear assembly.

10. The pencil sharpener of claim 1, wherein the gearbox is manufactured from metal.

11. An electric pencil sharpener, comprising:

(a) a DC motor having a voltage of about 120V;

(b) a cutter assembly, wherein the cutter assembly further includes:

(i) a rotating carrier, wherein the carrier further includes a carrier shaft;

(ii) at least two helical cutters mounted on the carrier, wherein the helical cutters define a conical cavity therebetween; and (iii) a barrel positioned at the large end of the conical cavity, wherein the barrel includes a bore formed therein for receiving a pencil; and (c) mechanical means for operatively connecting the motor to the cutter assembly, wherein the mechanical means for operatively connecting the motor to the cutter assembly further includes:

(i) a first gear assembly mechanically coupled to the motor;

(ii) a second gear assembly mechanically coupled to the first gear assembly and to the cutter assembly;

(iii) a gearbox for supporting the first and second gear assemblies; and (iv) a cover for enclosing the first gear assembly; and (d) a housing for containing the motor, cutter assembly, and the mechanical means for operatively connecting the motor to the cutter assembly, wherein the housing further includes:

(i) a canopy, wherein the canopy further includes an aperture in the front portion thereof, and wherein the aperture is adapted to receive a pencil; and (ii) a base positioned underneath the canopy, wherein the base further includes at least one mount formed thereon, and wherein the at least one mount is adapted to receive the bottom portion of the gearbox; and (e) at least one vibration dampening device positioned between the bottom of the gearbox and the top of the at least one mount formed on the base portion of the housing.

12. The pencil sharpener of claim 11, further comprising a plurality of elastomeric feet attached to the base for supporting the pencil sharpener above a surface upon which it has been placed.

13. The pencil sharpener of claim 11, wherein the helical cutters are left-handed cutters that are rotated counter-clockwise.

14. The pencil sharpener of claim 11, wherein the helical cutters are right-handed cutters that are rotated clockwise.

15. The pencil sharpener of claim 11, wherein the first gear assembly further includes a pinion gear, a carrier gear, and a third gear positioned between the pinion gear and the carrier gear.

16. The pencil sharpener of claim 11, wherein the second gear assembly further includes a helical drive gear and a bushing positioned between the helical drive gear and the carrier gear of the first gear assembly.

17. An electric pencil sharpener, comprising:

(a) a DC motor having a voltage of at least 120V;

(b) a cutter assembly, wherein the cutter assembly further includes:

(i) a rotating carrier, wherein the carrier further includes a carrier shaft;

(ii) at least two helical cutters mounted on the carrier, wherein the helical cutters define a conical cavity therebetween; and (iii) a barrel positioned at the large end of the conical cavity, wherein the barrel includes a bore formed therein for receiving a pencil; and (c) mechanical means for operatively connecting the motor to the cutter assembly, wherein the mechanical means for operatively connecting the motor to the cutter assembly further includes:

(i) a first gear assembly mechanically coupled to the motor;

(ii) a second gear assembly mechanically coupled to the first gear assembly and to the cutter assembly;

(iii) a metal gearbox for supporting the first and second gear assemblies; and (iv) a cover for enclosing the first gear assembly; and (d) a housing for containing the motor, cutter assembly, and the mechanical means for operatively connecting the motor to the cutter assembly, wherein the housing further includes:

(i) a canopy, wherein the canopy further includes an aperture in the front portion thereof, and wherein the aperture is adapted to receive a pencil; and (ii) a base positioned underneath the canopy, wherein the base further includes at least one mount formed thereon, and wherein the at least one mount is adapted to receive the bottom portion of the gearbox; and (e) at least one vibration dampening device positioned between the bottom of the gearbox and the top of the at least one mount formed on the base portion of the housing; and (f) a plurality of suction cup-shaped elastomeric feet attached to the base for supporting the pencil sharpener above a surface upon which it has been placed.

18. The pencil sharpener of claim 17, wherein the helical cutters are left-handed cutters that are rotated counter-clockwise or wherein the helical cutters are right-handed cutters that are rotated clockwise.

19. The pencil sharpener of claim 17, wherein the first gear assembly further includes a pinion gear, a carrier gear, and a third gear positioned between the pinion gear and the carrier gear.

20. The pencil sharpener of claim 17, wherein the second gear assembly further includes a helical drive gear and a bushing positioned between the helical drive gear and the carrier gear of the first gear assembly.

* * * * *